US006405530B1

(12) United States Patent
Brimeyer et al.

(10) Patent No.: US 6,405,530 B1
(45) Date of Patent: Jun. 18, 2002

(54) NON-FEEDBACK PROPORTIONAL ELECTRONIC CONTROL FOR A VARIABLE DISPLACEMENT PUMP

(75) Inventors: Richard D. Brimeyer; Todd M. Wehler, both of Ames, IA (US)

(73) Assignee: Sauer-Danfoss Inc., Ames, IA (US)

( * ) Notice: Subject to any disclaimer, the term of this patent is extended or adjusted under 35 U.S.C. 154(b) by 0 days.

(21) Appl. No.: 09/501,453

(22) Filed: Feb. 10, 2000

(51) Int. Cl.[7] ..... F16D 31/02
(52) U.S. Cl. ..... 60/444
(58) Field of Search ..... 60/444

(56) References Cited

U.S. PATENT DOCUMENTS 3,167,907 A * 2/1965 Kempson ..... 60/444
3,932,993 A * 1/1976 Reidhammer ..... 60/447
4,789,036 A * 12/1988 Haas ..... 60/444
5,048,294 A * 9/1991 Oshina et al. ..... 60/444

* cited by examiner

*Primary Examiner*—F. Daniel Lopez

(57) ABSTRACT

A hydraulic circuit includes a pump controlled by a two-stage non-feedback proportional control assembly. The first stage of the control assembly includes a single non-feedback proportional control valve that generates a displacement magnitude hydraulic signal that is proportional to an input signal. The second stage of the control assembly includes a directional control valve located downstream of the proportional control valve for conditioning and routing the displacement magnitude signal to the pump with an appropriate directional indicator.

16 Claims, 3 Drawing Sheets

NON-FEEDBACK PROPORTIONAL ELECTRONIC CONTROL FOR A VARIABLE DISPLACEMENT PUMP

BACKGROUND OF THE INVENTION

The present invention relates to the field of hydraulics. More particularly, this invention relates to variable displacement pumps in which non-feedback proportional control of the pump's displacement is desired. For a given operating condition, a non-feedback proportional control provides an output flow proportional to an input hydraulic signal (pressure) or electronic signal (current). The present invention is particularly useful when an electronic signal is available.

Various non-feedback proportional electronic (hereinafter NFPE) control assemblies are known and have become increasingly popular for axial piston variable displacement pumps used to propel various types of off-road vehicles, such as wheel loaders, aerial lifts, and various material handlers. One known NFPE control assembly makes use of a first NFPE control valve with a first proportional solenoid for controlling pump output in one direction and a second NFPE control valve with a second proportional solenoid for controlling pump output in the opposite direction. This conventional design is shown in FIG. 1.

Generally, vehicle operators want the pump to exhibit the same operating characteristics in forward and reverse. Any variation in operating characteristics (i.e., threshold, slope, etc.) between the two control valves and their respective proportional solenoids adds to the forward to reverse asymmetry exhibited by the pump. These variations exhibit themselves in undesirable variations in neutral threshold, full stroke and flow forward/current slope values for the pump being controlled. There is a need for a new type of NFPE control assembly that provides built-in symmetry or similarity between its forward and reverse command signals.

Therefore, a primary objective of the present invention is the provision of a NFPE control assembly that has built-in forward-to-reverse symmetry.

Another objective of this invention is the provision of a NFPE control assembly that avoids the problem of NFPE control valve-to-valve variation within the control assembly.

Another objective of this invention is the provision of a NFPE control system that utilizes a single NFPE control valve (proportional solenoid) to control the magnitude of the signal, coupled with a directional control valve to route control flow to the appropriate servo or side of the servo.

Another objective of the present invention is the provision of a NFPE control assembly that is less costly than existing arrangements.

Another objective of the present invention is the provision of a hydraulic circuit that includes a variable displacement hydraulic pump and a NFPE control assembly with symmetrical forward and reverse outputs.

These and other objectives will be apparent to one skilled in the art from the drawings, as well as from the description and claims that follow.

SUMMARY OF THE INVENTION

The present invention relates to a hydraulic circuit that includes a variable displacement hydraulic pump and a control assembly for the pump. The control assembly is a two-stage non-feedback proportional control assembly that is operatively associated with the pump. The first stage of the control assembly includes a single non-feedback proportional control valve that generates a displacement magnitude hydraulic signal that is proportional to an input signal. The second stage of the control assembly includes a directional control valve located downstream of the proportional control valve for conditioning and routing the displacement magnitude signal to the pump with an appropriate directional indicator.

DETAILED DESCRIPTION OF THE PREFERRED EMBODIMENT

Figure 1:
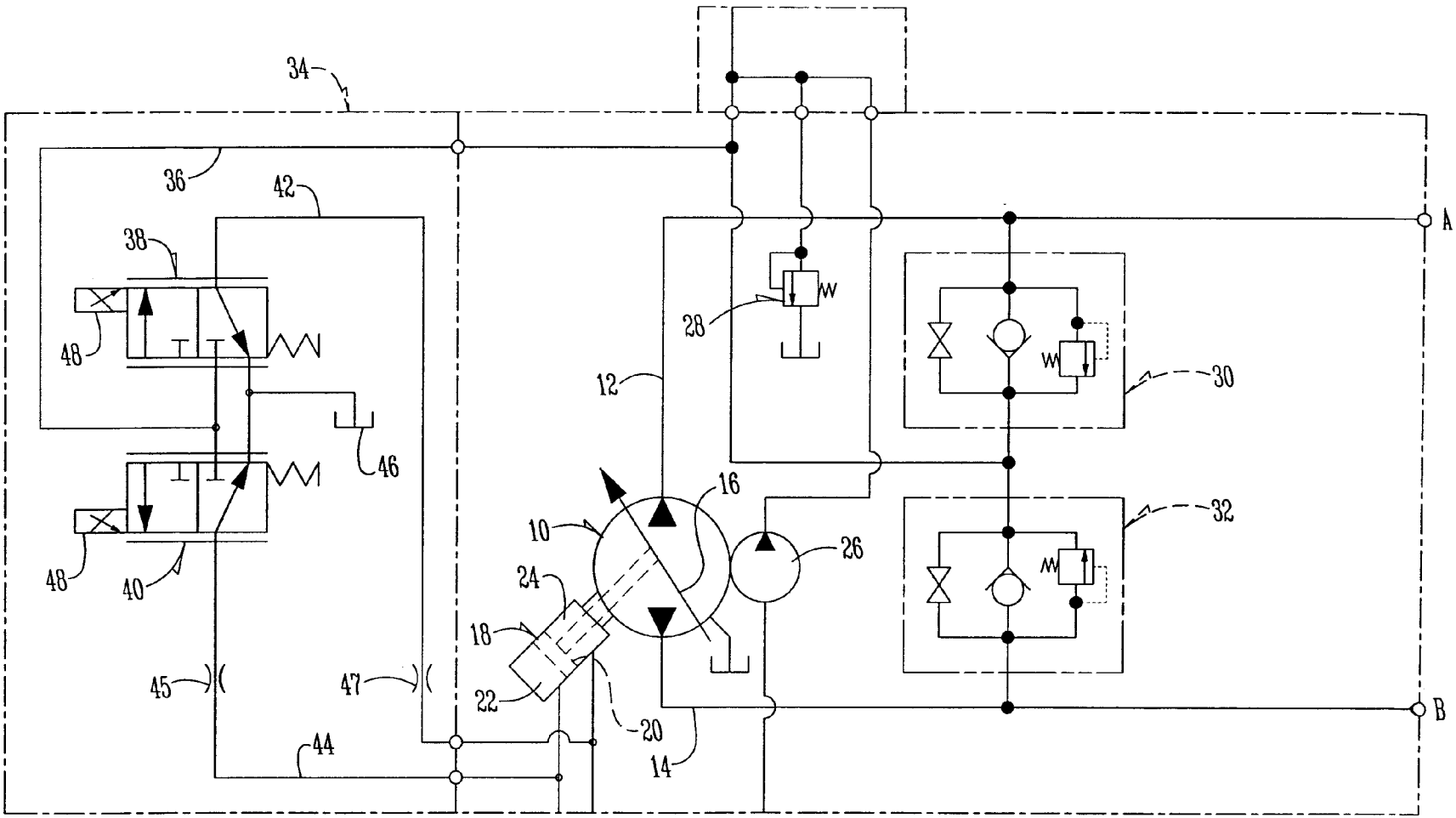
Fig. 1 (Prior Art)
FIG. 1 is a schematic diagram of a hydraulic pump circuit utilizing a conventional NFPE control valve assembly.

The present invention can be best understood by comparing it to a conventional design that is shown in FIG. 1. In order to propel a vehicle, a bi-directional variable displacement pump 10 is typically arranged in a conventional closed loop circuit with a hydraulic motor (not shown). The motor is fluidly connected to the pump 10 at ports A and B. The hydraulic motor is then drivingly connected to one or more of the wheels of the vehicle. Thus, the direction of fluid flow from the pump 10 through the closed loop circuit can be used to determine the direction of the vehicle. For instance, when the output flow of the pump 10 is directed to port A via a system pressure line 12, the vehicle may move in a forward direction. When the output flow of the pump 10 is directed to port B via a system pressure line 14, the vehicle may move in a reverse direction.

Figure 2:
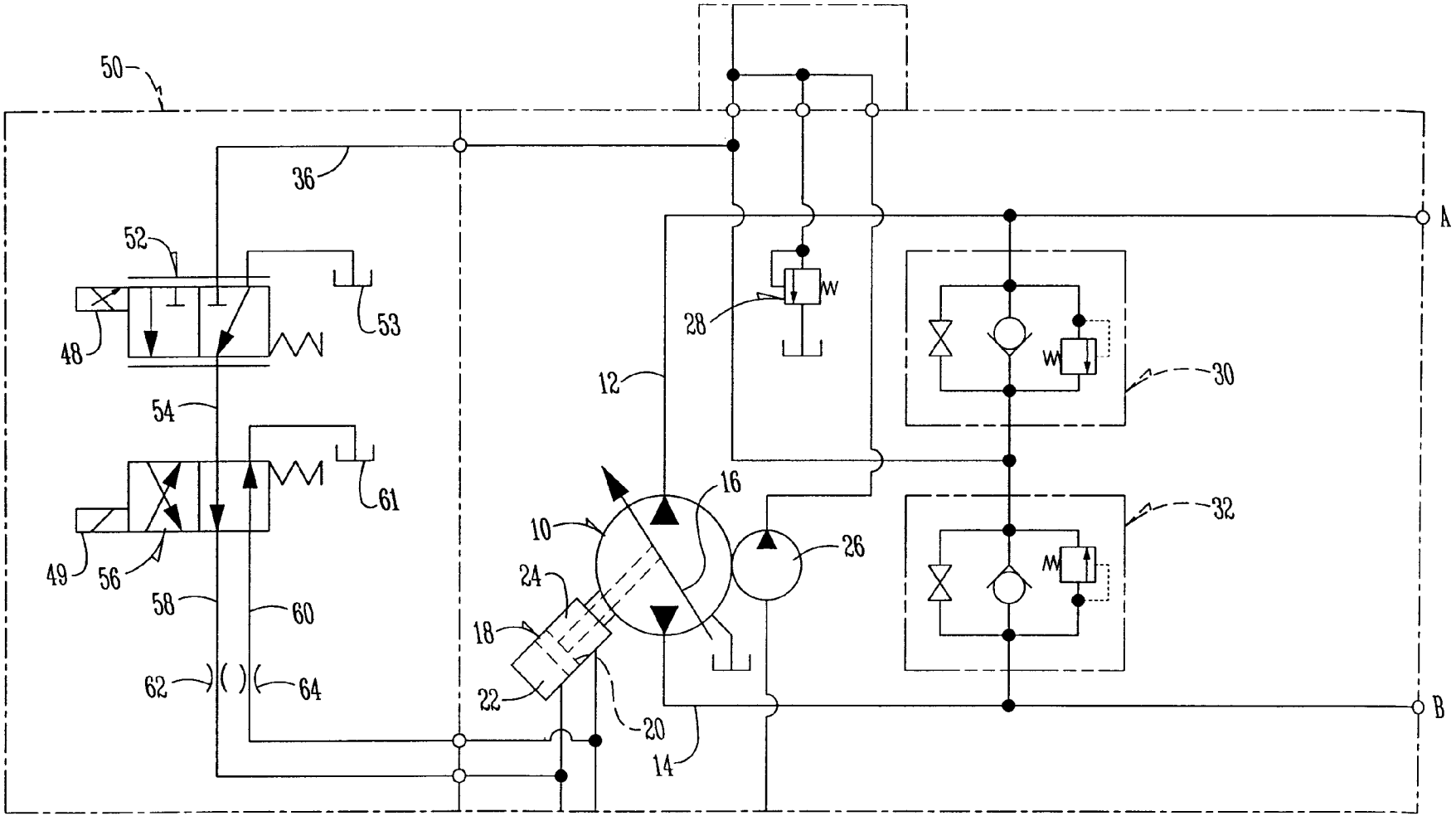
FIG. 2 is a schematic diagram similar to FIG. 1, but shows a unique NFPE control assembly according to the present invention.

Although the type of pump is not critical to the invention, the pump 10 shown in FIGS. 1 and 2 is preferably of the axial piston type. What is important, however, is that the pump 10 has a movable member 16 that varies the fluid displacement and the direction of output from the pump 10. In the preferred embodiment shown, the movable member 16 is a rotatable swashplate. The swashplate 16 has a neutral or zero-displacement position and can be rotated in opposite directions from the neutral position.

A servo mechanism 18 has a servo piston 20 that connects to the swashplate 16 and positions the swashplate 16 based upon a hydraulic pressure differential between two operably opposing servo chambers 22, 24 in the servo mechanism. Note that in the arrangement shown in FIG. 1, the opposing servo chambers 22, 24 are disposed on opposite sides of the single servo piston 20. However, one skilled in the art will appreciate that the servo mechanism 18 can include a single servo piston 20 coupled with the swashplate 16 as indicated in FIG. 1 or the servo mechanism 18 can include a pair of servo pistons, one connected to each end of the swashplate 16 to rotate it about its axis of rotation.

A charge pump 26 is operatively connected to the pump 10 in order to provide pressurized fluid flow for control purposes and to replenish the losses in the closed loop. A charge pressure relief valve 28 is included in the circuit to establish the pressure at which the flow is provided for these purposes. Conventional combination valves 30, 32 include pressure relief, check, and bypass components. The valves 30, 32 establish the maximum pressure differential between lines 12 and 14, allow charge pressure to enter the low side of the system loop, and permit bypassing for towing or other purposes as needed.

A conventional non-feedback proportional electronic (NFPE) control assembly 34 is operatively associated with the pump 10. The control assembly 34 is fluidly connected to the charge pump 26 so as to receive control flow and pressure through line 36. Line 36 connects to two NFPE control valves 38, 40. The valves 38, 40 generate two separate proportional hydraulic control signals to the opposing servo chambers 22, 24 respectively.

The electronic control valves 38, 40 are spring biased into a closed position where the lines 42, 44 from the servo mechanism 18 are drained to a common sump 46. Fixed orifices 45, 47 are included in the lines 42, 44 respectively to provide the desired pressure drop, response characteristics, and proper flow.

When an adjustable or variable electrical current is applied by the operator to the solenoid 48 of either valve 38, 40, the appropriate valve 38, 40 moves to the right and generates a hydraulic command signal through lines 42 or 44 that is proportional to the input current. The other of the valves 38, 40 is deactivated and therefore drains fluid to the sump from the corresponding chamber 22, 24 of the servo mechanism 18 through the corresponding line 42 or 44. Thus, in operation, displacement of the pump 10 in forward direction of travel for the vehicle is accomplished applying a current to the solenoid 48 of the control valve 38. On the other hand, if the reverse direction of travel of the vehicle is desired, the operator must apply a current to the solenoid 48 of the control valve 40.

FIG. 2 illustrates one embodiment of the present invention. In the figures, like reference numerals are used to refer to like components. The non-feedback proportional control assembly 50 shown in the left-hand portion of FIG. 2 is different than the control assembly 34 shown in FIG. 1. The control assembly 50 is a two-stage non-feedback proportional control assembly that preferably responds to an electronic input signal. The control assembly 50 operably connects to the pump 10 through the servo mechanism 18 so as to control the magnitude and direction of the displacement of the pump 10. The first stage of the electronic control assembly 50 consists of a single non-feedback proportional electronic (NFPE) control valve 52 that generates a displacement magnitude hydraulic signal into a line 54. The displacement magnitude hydraulic signal is proportional to the current input to the valve 52.

The displacement magnitude hydraulic command signal is conditioned (a directional indicator is applied) by a directional control valve 56 that is located downstream of or in series with the control valve 52. For the purposes of the invention, the directional control valve should be capable of reversing the direction of flow to the displacement actuating apparatus or servo mechanism 18. In other words, the directional control valve should be capable of alternating which servo chamber 22, 24 is connected to the control supply 36, 54 and which is connected or drained to the sump. Furthermore, it is desirable that in the "neutral" or "off" position of the NPFE control assembly, the actuating lines 58, 60 are both connected or drained to the sump 53 and/or 61.

In the preferred embodiment shown in FIG. 2, the directional control valve 56 is a two-position four-port valve. The first port communicates with the proportional control valve 52 through line 54. The second port communicates with the sump 61. The third port communicates with one of the servo chambers 22 via line or fluid passageway 58, and the fourth port communicates with the other of the servo chambers 24 via line or fluid passageway 60. The valve 56 is spring biased as shown and is solenoid-operated. Fixed orifices 62, 64 are included in lines 58, 60 respectively to provide the desired pressure drop, response characteristics, and proper flow.

In operation, the charge pump 26 provides control flow at a given pressure to the single NFPE control valve 52 through line or fluid passageway 36. In the absence of sufficient threshold currents at solenoids 48, 49, the control valves 52 and 56 are in the positions shown in FIG. 2 and the pump 10 is in a neutral (zero displacement) condition because both of the servo chambers 22, 24 are connected to sumps 53, 61. When the operator applies an input current to solenoid 48, the valve 52 opens and allows a flow (displacement magnitude signal) therethrough that is proportional to the current. The displacement magnitude signal generated by the control valve 52 is communicated to the directional control valve 56 through line or fluid passageway 54. In the absence of a threshold current being applied to the solenoid 49 of the valve 56, the valve 56 is spring biased into the position shown in FIG. 2. In this position, the valve 56 routes the displacement magnitude signal through line or fluid passageway 58 to chamber 22 of the servo mechanism 18. In response, the servo piston 20 urges the swashplate 16 to rotate in one direction and thereby increases the output flow of the pump 10 to port A. The other chamber 24 of the servo mechanism 18 drains to a sump 61 through line 60 and valve 56.

To change the direction of flow from the pump 10, the operator merely applies sufficient current to the solenoid 49 to shift the valve 56 to the position shown on the left in FIG. 2. In order to minimize jerkiness, it may be advisable to greatly reduce or eliminate the input current to the proportional valve 52 prior to applying current to solenoid 49 to shift the directional valve 56. In this position of the valve 56, the directional magnitude signal is routed to the servo chamber 24, which urges the swashplate 16 to rotate in an opposite direction and the pump 10 to increase its output flow to port B. The other servo chamber 22 is connected to the sump 61 through line 58 and the valve 56.

Figure 3:
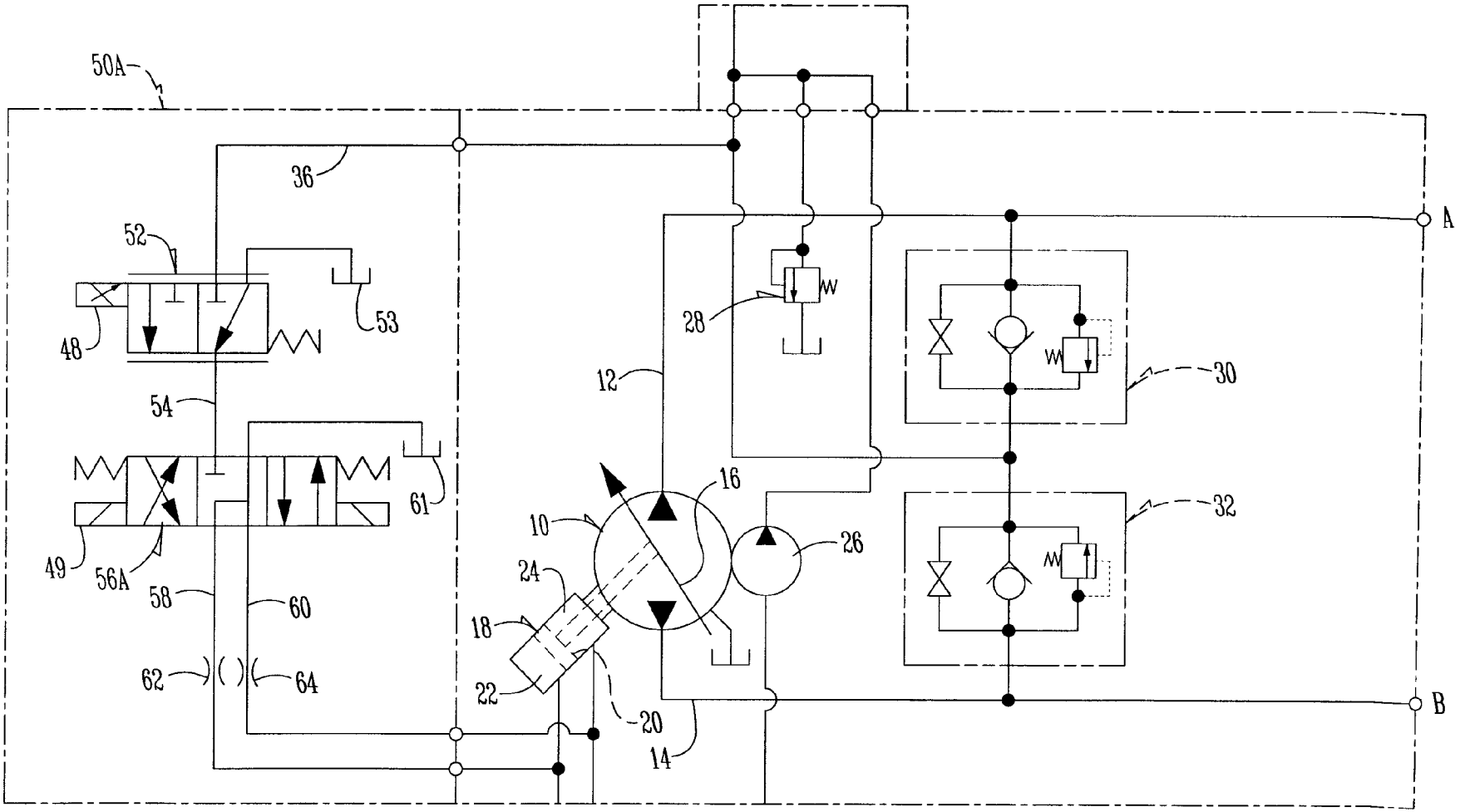
FIG. 3 is schematic diagram similar to FIG. 2, but shows another embodiment of the present invention.

Labeled as 50A in FIG. 3 is another embodiment of the NPFE control assembly of this invention. The two-position four-port directional valve 56 shown in FIG. 2 is replaced by a three-position four-port directional valve 56A. The directional valve 56A is solenoid-operated and spring centered into a neutral or "off" position wherein both actuator lines 58, 60 drain to the sump 61. The displacement magnitude command signal coming from line 54 is blocked in the third, central, or neutral position of the valve 56A.

With the present invention, the displacement command signal received by the pump 10 is always proportional to the current input to the single NFPE valve 52. Since there is only one NFPE valve providing the magnitude of the command signal, there is always symmetry between forward and reverse command signals and no valve-to-valve variation can occur.

Therefore, it can be seen that the present invention at least achieves its stated objectives.

In the drawings and specification, there has been set forth a preferred embodiment invention, and although specific terms are employed, these are used in a generic and descriptive sense only and not for purposes of limitation. Changes in the form and proportion of parts as well as in the substitution of equivalents are contemplated as circumstances may suggest or render expedient without departing from the scope of the invention.

What is claimed is:

1. A hydraulic circuit comprising:

a bi-directional flow variable displacement pump including a movable member therein for varying displacement;

a servo mechanism including two servo chambers therein operatively opposing each other, the servo mechanism being connected to the movable member so as to position the movable member based upon a hydraulic pressure differential between the servo chambers;

a two-stage non-feedback proportional electronic control assembly operatively connected to the pump through the servo mechanism for controlling the magnitude and direction of the displacement of the pump;

the first stage of the non-feedback proportional electronic control assembly consisting of a single non-feedback proportional electronic control valve that generates a displacement magnitude hydraulic command signal that is proportional to an input current;

the second stage of the electronic control assembly including a directional control valve operatively connected to the electronic control valve and the servo mechanism, the directional control valve includes a plurality of positions including a first position wherein the displacement magnitude signal is received from the electronic control valve and ported to one of the opposing servo chambers so as to vary the flow of the pump in a first direction and a second position wherein the displacement magnitude signal is received from the electronic control valve and ported to the other of the opposing servo chambers so as to vary the flow of the pump in a second direction.

2. The hydraulic circuit of claim 1 wherein the electronic control valve and the directional control valve are in series with each other.

3. The hydraulic circuit of claim 2 wherein the directional control valve is located downstream of the electronic control valve.

4. The hydraulic circuit of claim 1 wherein the non-feedback proportional electronic control valve is a solenoid-operated spool valve that is normally urged by a spring into a position wherein the electronic control valve is fluidly connected to a sump.

5. The hydraulic circuit of claim 1 wherein the directional control valve is a solenoid-operated two-position valve having four ports, a first port fluidly connected to the electronic control valve so as to receive the displacement magnitude signal, a second port connected to a sump, a third port connected to one of the chambers of the servo mechanism and a fourth port connected to the other of the chambers of the servo mechanism, whereby in the first position of the directional control valve the first and third ports are in communication with each other and the second and fourth ports are in communication with each other, and whereby in the second position of the directional control valve the first and fourth ports are in communication with each other and the second and third ports are in communication with each other.

6. The hydraulic circuit of claim 5 wherein the directional control valve is normally urged into the first position by a spring and the solenoid must overcome the spring to move the directional control valve into the second position.

7. The hydraulic circuit of claim 1 comprising a charge pump fluidly connected with the variable displacement pump and the electronic control valve so as to supply hydraulic fluid to pump and to the control assembly.

8. The hydraulic circuit of claim 1 wherein the directional control valve is three-position four-port valve.

9. The hydraulic circuit of claim 1 wherein the directional control valve is three-position four-port valve that is solenoid operated and spring centered into a neutral or third position, between the first and second positions, in which the displacement signal is blocked and pressure downstream of the three-position four-port valve is drained to a sump through the three-position four-port valve.

10. A hydraulic circuit comprising:

a bi-directional flow variable displacement pump including a movable member therein for varying displacement;

a two-stage non-feedback proportional electronic control assembly operatively connected to the movable member of the pump for controlling the magnitude and direction of the displacement of the pump;

the first stage of the non-feedback proportional electronic control assembly including a non-feedback proportional electronic control valve that generates a displacement magnitude hydraulic command signal that is proportional to an input current;

the second stage of the electronic control assembly including a two-position directional control valve operatively connected to the electronic control valve and the pump such that in a first position the displacement magnitude signal is received from the electronic control valve and ported through the directional control valve so as to vary the flow of the pump in a first direction and in a second position the displacement magnitude signal is received from the electronic control valve and ported through the directional control valve so as to vary the flow of the pump in a second direction.

11. A control valve assembly for controlling fluid displacement of a variable displacement pump, the control valve assembly comprising:

a single non-feedback proportional spool valve for receiving fluid from a source of hydraulic fluid and using said fluid to generate a displacement magnitude hydraulic signal that is proportional to an input signal to the spool valve;

a directional control valve downstream of and connected in series to the spool valve for adding a directional indication to the displacement magnitude signal and routing the displacement magnitude signal with the directional indication to the pump.

12. The control assembly of claim 11 wherein the spool valve is a solenoid operated valve and the input signal is an electrical signal, the spool valve being normally urged by a spring into a position wherein the spool valve is fluidly connected to a sump.

13. The control assembly of claim 11 wherein the directional control valve is a solenoid-operated valve that includes a plurality of positions including a first position for applying a forward directional indication to the pump and a second position for applying a reverse directional indication to the pump.

14. The control assembly of claim 13 wherein the directional control valve is a three-position four-port valve.

15. The control assembly of claim 14 wherein the three-position four-port valve is solenoid operated and spring centered into a central neutral or third position in which the displacement magnitude signal is blocked and pressure downstream of the three-position four-port valve is drained to a sump through the three-position four-port valve.

16. The control assembly of claim 13 wherein the directional control valve is a two-position four-port valve.

* * * * *